US008640770B1

(12) United States Patent
Smith et al.

(10) Patent No.: US 8,640,770 B1
(45) Date of Patent: Feb. 4, 2014

(54) END RING FOR USE WITH SWELL PACKERS

(71) Applicant: LB Enterprises, LLC, Anchorage, AK (US)

(72) Inventors: Lee Morgan Smith, Anchorage, AK (US); Betty A. Eastup-Smith, Anchorage, AK (US)

(73) Assignee: LB Enterprises, LLC, Anchorage, AK (US)

( * ) Notice: Subject to any disclaimer, the term of this patent is extended or adjusted under 35 U.S.C. 154(b) by 0 days.

(21) Appl. No.: 13/852,861

(22) Filed: Mar. 28, 2013

Related U.S. Application Data

(60) Provisional application No. 61/699,999, filed on Sep. 12, 2012.

(51) Int. Cl.
*E21B 17/02* (2006.01)
*E21B 23/06* (2006.01)
*E21B 33/12* (2006.01)

(52) U.S. Cl.
USPC ..... 166/242.6; 166/242.1; 166/187; 166/387

(58) Field of Classification Search
USPC ..... 166/122, 187, 242.1, 242.6, 387
See application file for complete search history.

(56) References Cited

U.S. PATENT DOCUMENTS

2012/0255786 A1 10/2012 Isenhour

*Primary Examiner* — David Bagnell
*Assistant Examiner* — Richard Alker
(74) *Attorney, Agent, or Firm* — Buskop Law Group, PC; Wendy Buskop

(57) ABSTRACT

An end ring having a first ring with an inner diameter, a second ring with the inner diameter and a thickness 25 percent greater than the first ring; a shoulder with a sloped outer surface connecting the first ring to the second ring; a plurality of flutes formed in an outer surface of the end ring, a plurality of fastener holes formed in the first and second rings, wherein the end ring either slides over a first end of a base pipe and fastens together the base pipe and edges of a rubber tubular surrounding the base pipe; or slides over a first end of a frac tubular and fastens edges of a frac sleeve to the frac tubular. The invention includes a swell packer and a frac tubular having the end rings.

13 Claims, 4 Drawing Sheets

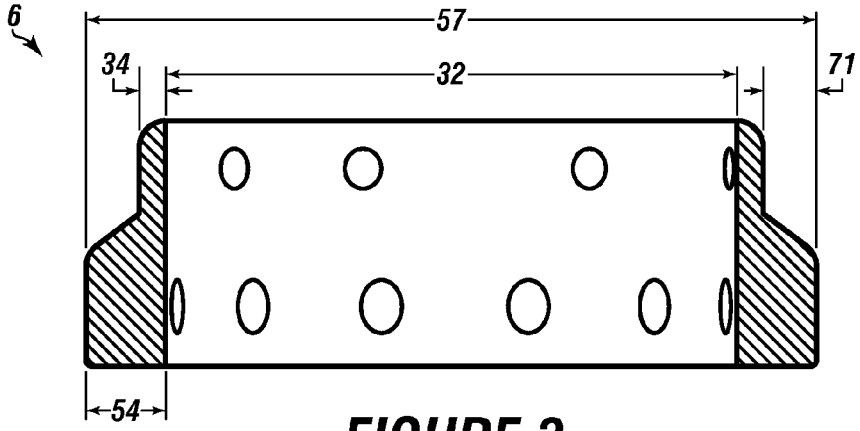
FIGURE 3
FIGURE 4
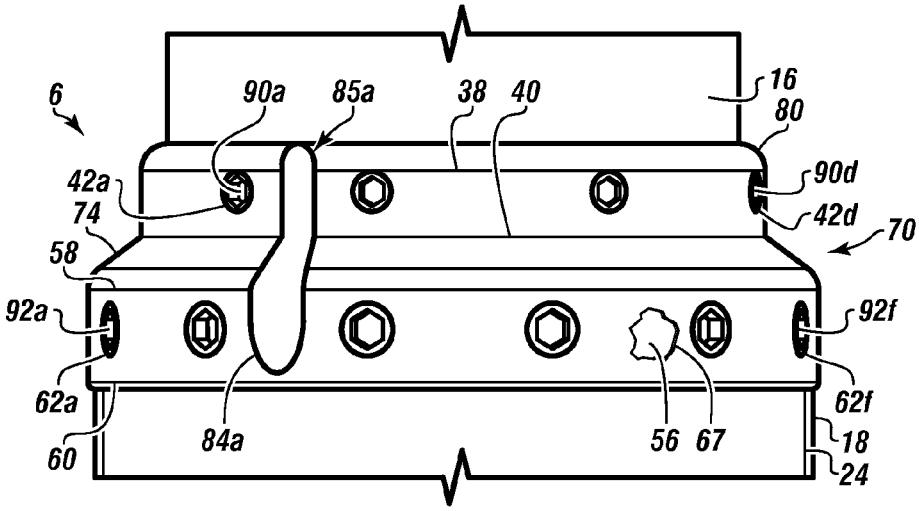
FIGURE 5
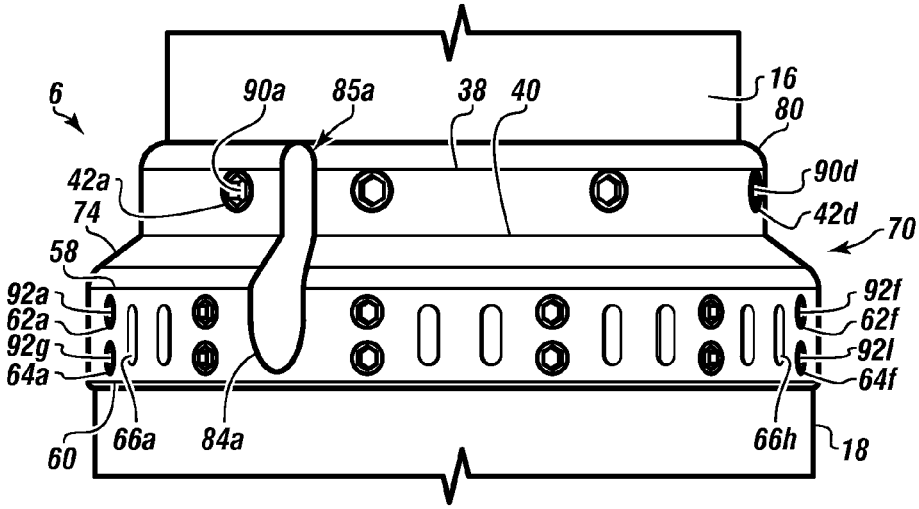

END RING FOR USE WITH SWELL PACKERS

CROSS REFERENCE TO RELATED APPLICATIONS

The current application claims priority and the benefit of U.S. Provisional Patent Application Ser. No. 61/699,999 filed on Sep. 12, 2012, entitled "FLANGED END RING FOR USE WITH SWELL PACKERS." This reference is incorporated herein in its entirety.

FIELD

The present embodiments generally relate to an end ring for use with swell packers, a swell packer with end rings installed, and a frac tubular with end rings installed.

BACKGROUND

A need exists for running a swell packer to the bottom of a well without the swell packer jamming or stopping midway.

A need exists for running a frac string to the bottom of a well or to a target depth without the frac string catching on the well midway down the borehole.

A need exists for an easy to install end ring for swell packers and frac strings that allows the swell packers and frac strings to be easily positioned at the target depth in a wellbore particularly for oil and natural gas wells.

A need exists for an easy to install end ring for swell packers and frac strings that holds the tubular or sleeve on the swell packer or frac string enabling the swell packer or frac string to slide easily into the well, reducing the possibility of explosions.

The present embodiments meet these needs.

BRIEF DESCRIPTION OF THE DRAWINGS

The detailed description will be better understood in conjunction with the accompanying drawings as follows:

FIG. 3 is another cross sectional view of the end ring according to one or more embodiments.

FIG. 4 shows a side perspective view of an end ring connected to a base pipe and to a rubber tubular of a swell packer according to one or more embodiments.

FIG. 5 is a perspective view of another embodiment of an end ring according to one or more embodiments.

Figure 1:
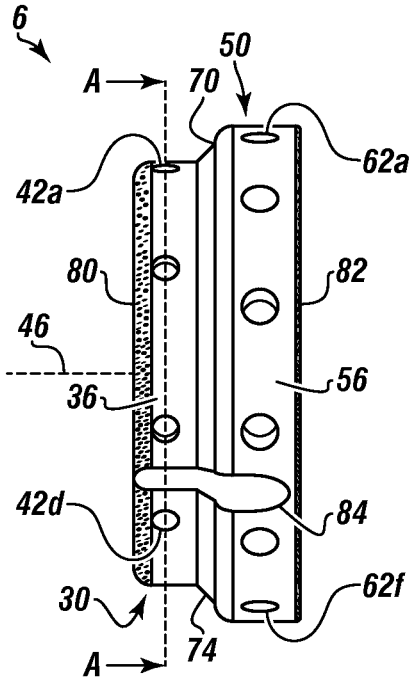
FIG. 1 is a side view of the end ring according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments generally relate to an end ring having a first ring with an inner diameter and a second ring with the same inner diameter as the first ring. The second metal can have a thickness 25 percent greater than the first ring thickness and can be connected to the first ring using a shoulder. The first ring and the second ring can be metal.

The shoulder can have an inner diameter that is identical to the first ring inner diameter. The shoulder can have a sloped outer surface connecting the first ring to the second ring.

A plurality of flutes can be tapered in embodiments, and can be formed in an outer surface of the end ring. The flutes can allow the passage of particulate as the end ring, when attached to a swell packer or to a frac tubular, is pushed down a wellbore in a direction opposite the direction of insertion of the frac tubular or swell packer.

A plurality of fastener holes can be formed in each of the first ring and second ring. The fastener holes can differ in diameter. In the first ring, which can be thinner, the fastener holes can be smaller in diameter than in the second ring, which can be thicker.

For installation on a swell packer, the end ring can be slid over a first end of a base pipe and fasten together the base pipe and edges of a rubber tubular surrounding the base pipe.

The rubber exterior tubular can be a hard high durometer material capable of withstanding pressures from 100 psi to 10,000 psi and temperatures from 100 degrees Fahrenheit to 500 degrees Fahrenheit.

For installation on a frac tubular, the end ring can be slid over a first end of a frac tubular and fasten together edges of a frac sleeve to the frac tubular.

The frac tubular can be a high strength metal, such as steel, that can withstand pressures of at least 10,000 psi.

One or more embodiments can include a frac tubular having the end rings and a swell packer having the end rings.

A benefit of the apparatus is that the end rings on the swell packer enable the swell packer to slide into the well to a desired depth without tripping out. Tripping is one of the most dangerous activities at the well site and can kill well site personnel. The use of the end rings on the swell packer can save lives and reduce potential physical injury.

The present embodiments can allow a swell packer that is designed to go to the bottom of the well to slide without stopping all the way to the desired depth, which can be the bottom of the wellbore, without separating the liner of the swell packer from the base pipe. When the liner separates from base pipe in a swell packer as the swell packer is run into a well, damage can occur and cause costly trips into the well to retrieve the damaged liner. The end rings on the swell packer can prevent damaging liners to the swell packers.

When a swell packer fails to reach a wellbore bottom, the rig must pull the swell packer back up the wellbore. If the swell packer separates in the wellbore, and comes apart, it can take a rig crew up to 3 weeks, making multiple trips, to get the liner out of the wellbore. If the crew is unsuccessful fishing the liner from the well, the crew may have to sidetrack the wellbore and drill another hole. The cost for fishing and the cost for sidetracking the wellbore and drilling another wellbore can be very high, even more than $1,000,000. The swell packer with these unique end rings prevents this unnecessary expense.

The embodiments of a swell packer, or in the embodiment of a frac tubular or simply as end rings, helps control unexpected drilling/production costs, and keeps the well production process more safe.

Maximum production occurs when the swell packer with liner intact goes to bottom. When the swell packer goes to the bottom drilling costs are minimized and this should keep costs for gas at the pump lower.

The end rings of the present embodiments can include flutes that are cut in the outside of the end rings.

These "cuts" or "flutes" can allow well particulate and well fluid to pass by the end rings instead of grabbing at the liner and sticking to the liner in the wellbore, stopping swell packer or frac tubular penetration.

The flutes can enable drilling fluid to flow out of the well as the swell packer or frac tubular is run into the well increasing the chance for the swell packer or frac tubular to land, intact, where needed in the wellbore.

The flutes can vary in number. From 2 to 6 flutes can be formed in each end ring, though in embodiments, up to 20 flutes can be used in any one end ring.

In embodiments, the end ring can have a first ring lip on an end of the first ring opposite the shoulder.

The end ring can have a second ring lip on the end of the second ring opposite the shoulder.

The ring lips can ensure particulate continues to smoothly flow over the end ring without getting stuck on the end ring or on the rubber tubular of a swell packer or on the frac sleeve of a frac tubular.

In one or more embodiments, the ring lips can be beveled.

In embodiments, the end ring can use cutting elements, such as cutting ridges on the outer surfaces of the rings and shoulder, particularly the larger of the two rings, to help ream the wellbore, helping to keep the wellbore clear and letting drill cuttings pass by the liner without tearing the liner to shreds.

The cutting elements can be formed on an outer surface of an end ring, allowing the swell packer or frac tubular to be slowly worked into the well while simultaneously reaming the wellbore as the liner portion of the swell packer is run to the bottom or target depth of the well.

This reaming while running embodiment of the invention can perform two different jobs simultaneously, which can save time and prevent damage to the frac tubular and swell packer.

In embodiments, the end ring can be used to bidirectionally ream a wellbore with a wellbore axis, reaming in two directions, (i) into a wellbore and (ii) out of a wellbore.

The end ring can allow swell packers to go to the bottom of a wellbore very easily, at least 10 percent more easily than known swell packers without the end ring.

The end rings for swell packers can also prevent the rubber on the base pipe of the swell packer from expanding longitudinally and enable the rubber to expand perpendicular to the base pipe so as to seal off the wellbore, which helps during stimulation of production from the well. A benefit of the end rings is to control swelling longitudinally.

Most swell packers handle only 5000 psi. When two end rings are installed on a base pipe and connected to the rubber tubular, these end rings can enable a swell packer to accommodate pressure in the well of 5000 psi to 10000 psi.

Embodiments of the end ring can have, in addition to a single row of fastener holes, a second or even a third row of fastener holes, which can be created in each ring.

Each hole can contain a fastener. Each fastener can be used to help the swell packer sustain the pressure without shredding.

In embodiments, the multiple rows of fastener holes can be in the thicker second ring only and still facilitate the end ring sustaining a high pressure of 8000 psi to 10000 psi for the swell packer without having the rings separate from the liner or the liner separate from the base pipe.

In embodiments, the end rings can be 0.0125 millimeters larger in diameter than the rubber tubular of the swell packer.

The swell packer can have a base pipe with a first end and a second end, and a swell packer material disposed over the base pipe which can be a rubber tubular. Other polymers can be used as the rubber tubular, provided the polymer can swell in the presence of a well fluid pumped down the wellbore while the swell packer is in the wellbore.

For the swell packer, a first end ring can be fastened between the base pipe and the swell packer first end; a second end ring can be fastened between the base pipe and the swell packer second end; and a collar can typically be connected to the second end of the base pipe.

In one or more embodiments, the second ring of the end ring can be slightly thicker, such as 10 percent, and larger in outer diameter than the outer diameter of the rubber tubular of the swell packer. This configuration of the end ring can allow the swell packer to run smoothly into and out of the wellbore, wherein the weight can be distributed onto the end ring. In this embodiment, the swell packer can ride or move on the end ring, which can in turn protect the rubber tubular.

In an embodiment in which the diameter of the rubber tubular is 5.675 inches, the end rings can be 5.70 inches in diameter, that is, 0.025 inches larger than the rubber tubular of the swell packer.

In another embodiment, the diameter of the rubber tubular can be from 0.010 inches to 0.5 inches, and the end ring can have a diameter of 5 percent to 10 percent larger than the rubber tubular of the swell packer.

In an embodiment using the double row of fasteners to hold the end ring, the end ring can be used to prevent the rubber of the swell packer from expanding laterally and to control rubber swelling to a direction perpendicular to the axis of the wellbore or drill pipe, thereby providing a higher pressure seal.

The end rings can also be used for fractionation strings, which are fastened together frac tubulars. The frac strings are used in fracking wells to stimulate production.

The swell packers and frac tubulars of the present invention can be installed in a wellbore by well rig hands that don't need any extra training on how to fish liners out of the hole.

The flutes around the edges of the end ring can allow lower hydraulic pressure in the well as the swell packers are run into the wellbore while not breaking the formation down as the swell packers are installed and not hanging up the packers in the wellbore.

The invention relates to a frac tubular for forming a frac string for use in a wellbore having a depth. The frac tubular can include a threaded end and a cap end.

A frac sleeve support zone can be formed on the frac tubular providing a reinforced sliding surface. The frac sleeve can be positioned over the frac sleeve support zone. The frac sleeve can have a frac sleeve first end and a frac sleeve second end.

A first end ring can be fastened to the frac sleeve on the frac sleeve first end.

The frac tubular can be made from steel, stainless steel, or high strength composite materials.

In one or more embodiments, the end ring can be beveled on all edges, which can prevent the device from hanging up or getting caught while running into and out of a wellbore.

In an embodiment, the fastener holes in the end ring can be used to ream the wellbore.

In embodiments, the end ring can be made with a layer of carbide material on the outside surface. The carbide material can be used as the cutting material to ream the ledges around the wellbore allowing the swell packers to be installed to a maximum wellbore depth. In one or more embodiments, the end rings can be used with 20 swell packers to 80 swell packers in line in a single run.

Turning now to the Figures, FIG. 1 is a side view of the end ring according to one or more embodiments.

The end ring 6 can have a first ring 30 with a first ring outer surface 36. The first ring 30 can be a thin metal ring.

The end ring 6 can also have a second ring 50 with a second ring outer surface 56. The second ring 50 can be a thicker metal ring with a thickness that can be at least 25 percent greater than the first ring thickness.

A shoulder 70 can connect the first ring 30 and second ring 50. The shoulder 70 can have a sloped outer surface 74.

The end ring 6 can slide over a first end of a base pipe or frac tubular and connect edges of the tubular sheath which can be a rubber tubular or a frac sheath to the base pipe or frac tubular.

A first ring lip 80 can be formed on the first ring second edge and can be beveled.

A second ring lip 82 can be formed on a second ring edge opposite the shoulder. The second ring lip can be beveled.

The first ring 30 and the second ring 50 can have fastener holes. In this Figure the first ring is shown with first ring fastener holes 42*a* to 42*d*. The second ring is shown with second ring fastener holes 62*a* to 62*f*. In an embodiment, the fastener holes can be screw holes.

The second ring can have carbide material on the outer surface as a layer. In one or more embodiments the carbide material can be a layer and/or can be a button of polycrystalline material, such as a diamond material; a PDC material, such as PDC buttons; or PDC cutters, such as those from Guilin Star Diamond Superhard Materials Co., Ltd. of China, which can aid in reaming the wellbore.

The end ring can be a ring structure with a longitudinal axis 46. The ring can be hollow to grab the rubber tubular and base pipe of a swell packer.

A flute 84 can be formed on the outer surface of the end ring 6. In one or more embodiments, each flute can be formed on the end ring at a right angle to the longitudinal axis.

In embodiments, the shoulder can be straight angled or stair stepped, depending upon application.

Figure 2:
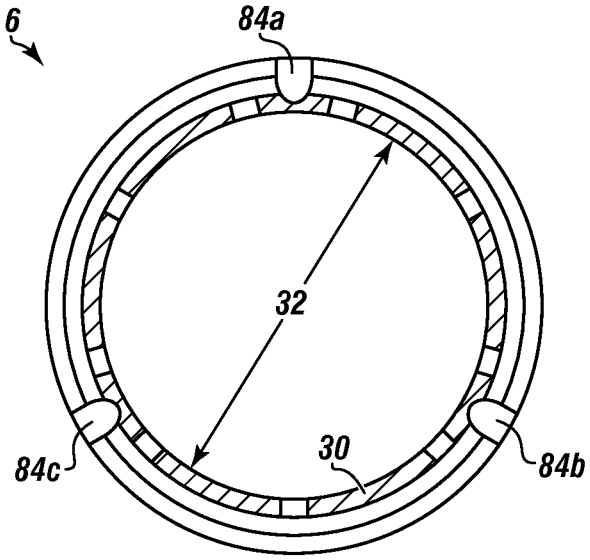
FIG. 2 is a cross sectional top view of the end ring depicting the first ring connected to the shoulder and the second ring wherein the shoulder, and rings all have the same inner diameter according to one or more embodiments.

FIG. 2 is a cross sectional top view of the end ring depicting the first ring connected to the shoulder and the second ring wherein the shoulder, and rings all have the same inner diameter according to one or more embodiments.

The end ring 6 with the first ring 30 having an inner diameter 32 is shown. The second ring can have the same inner diameter 32, but a thickness almost twice as wide as the first thin metal ring.

Three flutes 84*a*, 84*b*, and 84*c* are depicted formed through the entire width of the second ring and extending into a portion of the first ring.

FIG. 3 is another cross sectional view of the end ring according to one or more embodiments.

The inner diameter 32 is shown along with the first ring thickness 34 and second ring thickness 54.

The end rings are usable with swell packers, which can be made from a central metal tubular, such as a base pipe, with a rubber exterior tubular disposed over the base pipe. In a swell packer, the rubber exterior tubular swells in the presence of a well completion fluid, such as water or oil, or in the presence of other well drilling fluids.

The shoulder thickness 71 of the shoulder 70 is also depicted.

The second ring outer diameter 57 is also shown.

FIG. 4 shows a side perspective view of an end ring connected to a base pipe and to a rubber tubular of a swell packer according to one or more embodiments.

The end ring 6 can sealingly engage one end of the rubber exterior tubular disposed over the base pipe 16.

There can be a flute 84*a* with a tapered end 85*a* formed in the exterior side of the end ring.

The first ring can have first ring fastener holes 42*a*-42*d*. The second ring can have second ring fastener holes 62*a*-62*f*.

A plurality of fasteners 90*a*-90*d* and 92*a*-92*f* are shown installed in the plurality of fastener holes. The fasteners can be screws. Each fastener in the first ring can attach to the base pipe 16. Each fastener in the second ring can attach to the rubber exterior tubular 18.

Carbide material 67 is shown on the second ring outer surface 56.

In this embodiment, the end ring can engage a diffuser layer 24 positioned around the rubber tubular of the swell packer.

The shoulder 70 can have a sloped outer surface 74. The shoulder 70 can be disposed between the second ring first edge 58 and the first ring second edge 40.

The first ring first edge 38 and the first ring second edge 40 and the second ring first edge 58 and the second ring second edge 60 are also shown.

In one or more embodiments, from 2 fastener holes to 20 fastener holes can be used per ring. The amount of fastener holes on the first ring can differ from the amount of fastener holes on the second ring.

In one or more embodiments, the first ring can have an outer diameter ranging from 1 inch to 36 inches.

In one or more embodiments, from 2 flutes to 20 flutes can be used per ring.

In still other embodiments, the flutes can each have a depth from 5 percent to 55 percent of the thickness of one of the rings.

The rings can be made from stainless steel. The cutting layer can be carbide.

In an embodiment, the first ring can be made from a first material and the second ring can be made from a different material to provide for different physical properties, such as improved durometer and/or better gripping.

In an embodiment, the edges of the rings can have teeth, such as razor like jagged teeth, to better grip the rubber of the swell packer.

FIG. 5 is a perspective view of another embodiment of an end ring according to one or more embodiments. This Figure shows the end ring with a double row of fastener holes.

In this Figure the end ring 6 is similar to the end ring shown in FIG. 4 but in this embodiment the end ring depicts a second row of second ring fastener holes 64*a*-64*f* in addition to the first row of second ring fastener holes 62*a*-62*f*.

A plurality of first diameter fasteners 92*a*-92*d* for the first row of second ring fastener holes and a plurality of second diameter fasteners 92*g*-921 for the second row of second ring fastener holes are shown.

Cutting ridges 66*a*-66*h* are shown formed on an outer surface of the second ring.

Also shown is the second ring second edge 60; the rubber exterior tubular 18; a sloped outer surface 74 of the shoulder 70, a second ring first edge 58, a base pipe 16, a first ring lip 80; a flute 84*a* with a tapered end 85*a*; a first ring first edge 38; a first ring second edge 40; first ring fastener holes 42*a*-42*d*; and fasteners 90*a*-90*d* on the first ring.

Figure 6:
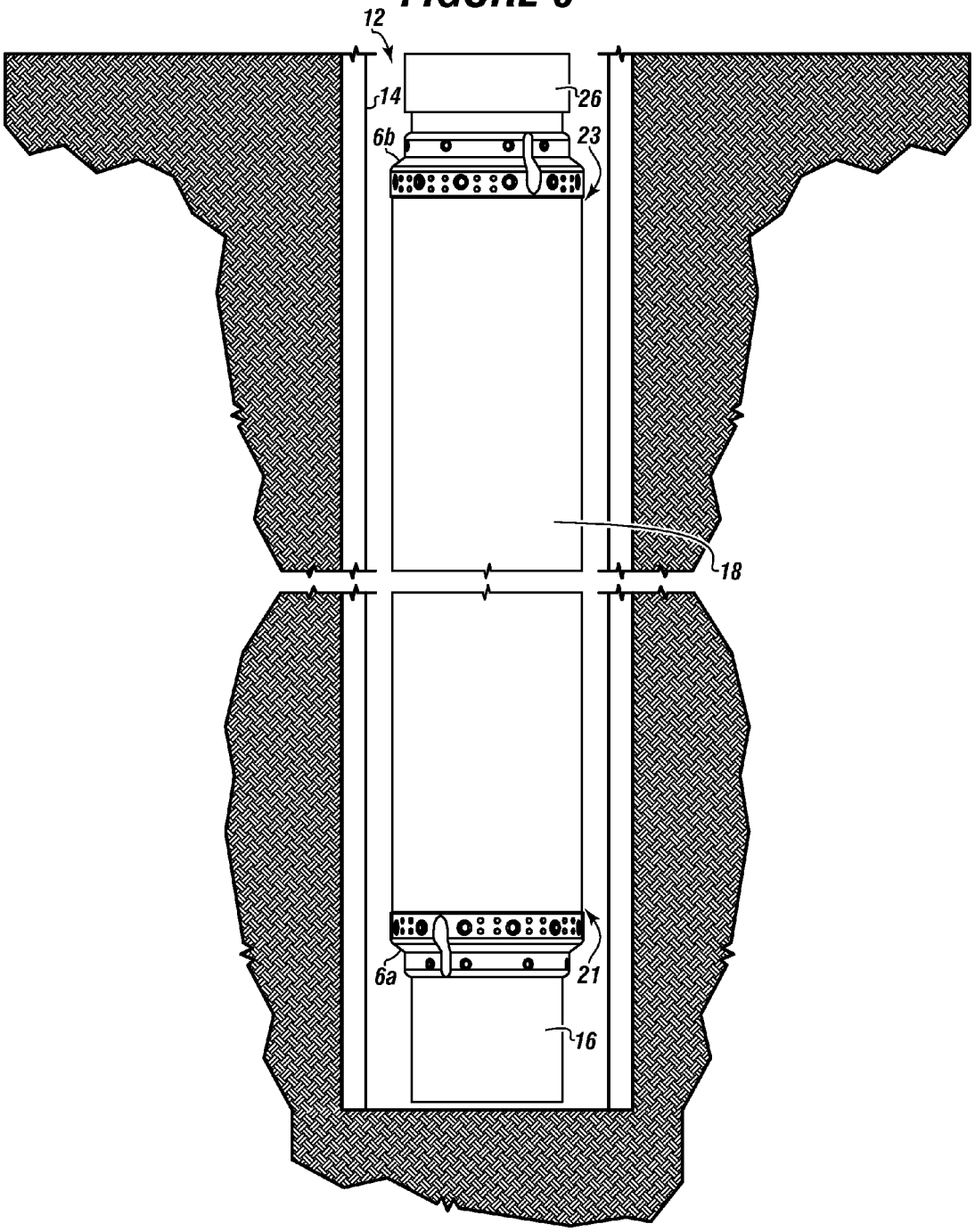
FIG. 6 depicts a swell packer with two end rings secured thereto in a wellbore according to one or more embodiments.

FIG. 6 depicts a swell packer with two end rings secured thereto in a wellbore according to one or more embodiments.

The swell packer 12 can have a first end 21 and a second 23 in a wellbore 14. The swell packer 12 can be made from a base pipe 16, a tubular sheath 18, a first end ring 6*a* and a second end ring 6*b*. The end rings can engage the edges of the tubular sheath and the base pipe simultaneously. The swell packer can have a collar 26 on the end furthest from wellbore depth.

Figure 7:
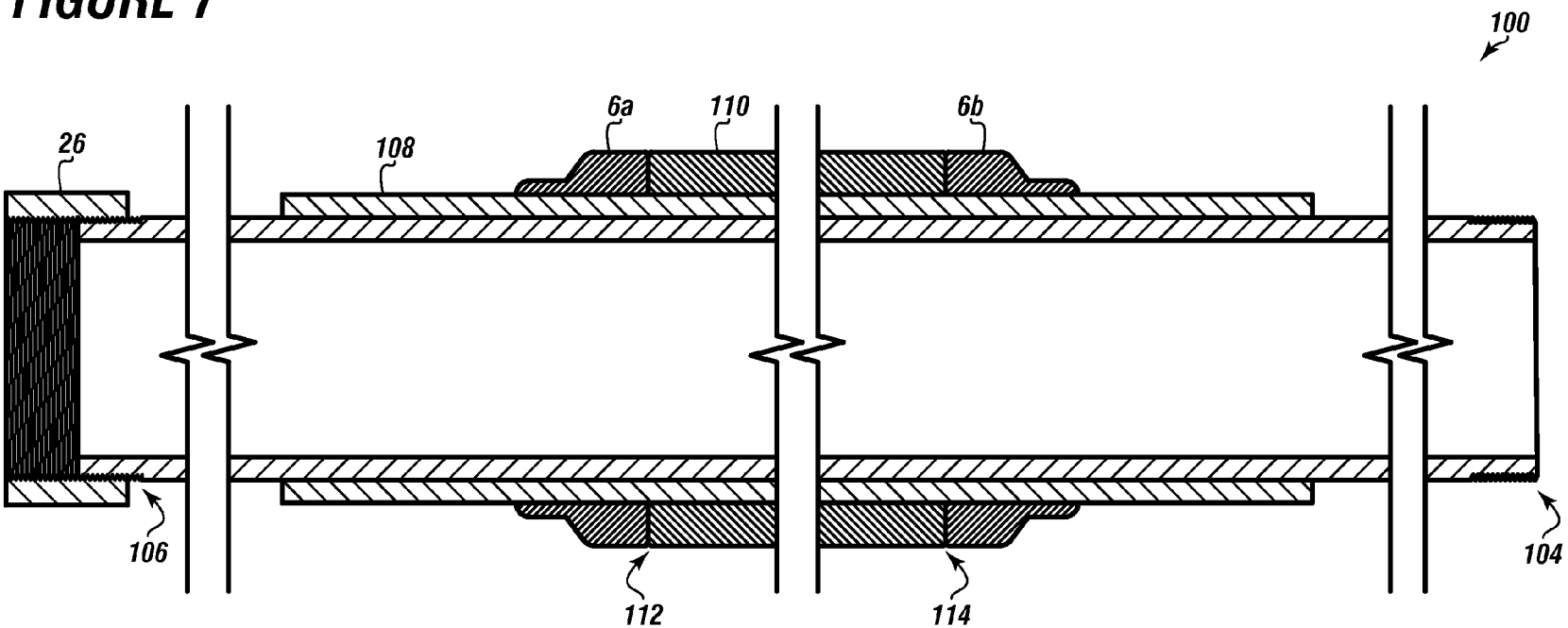
FIG. 7 shows a frac tubular with two end rings secured thereto according to one or more embodiments.

FIG. 7 shows a frac tubular with two end rings secured thereto according to one or more embodiments.

The frac tubular 100 can have a threaded end 104, a cap end 106, a frac sleeve support zone 108, a frac sleeve 110, a frac sleeve first end 112, and a frac sleeve second end 114.

The frac tubular can have a first end ring 6*a*, a second end ring 6*b*, and a collar 26.

For example, two end rings can be used to connect two different swell packers together, such as one end ring for an oil swell packer and one end ring for a water swell packer.

As another example, the two end rings can be used to connect a fresh water swell packer to a salt water swell packer.

While these embodiments have been described with emphasis on the embodiments, it should be understood that within the scope of the appended claims, the embodiments might be practiced other than as specifically described herein.

What is claimed is:

1. An end ring for a downhole tool having a base pipe and a tubular sheath partially covering the base pipe, wherein the downhole tool is for use in a wellbore, and wherein the end ring comprises:

a. a first ring having an inner diameter, a first ring thickness, a first ring outer surface, a first ring first edge, and a first ring second edge;

b. a second ring having the inner diameter, a second ring thickness, a second ring outer surface, a second ring first edge, and a second ring second edge; and wherein the second ring thickness is at least 25 percent greater than the first ring thickness;

c. a shoulder having the inner diameter, and wherein the shoulder has a sloped outer surface connecting the first ring second edge to the second ring first edge; and wherein the end ring slides over the base pipe and connects edges of the tubular sheath to the base pipe;

d. a first ring lip formed on the first ring second edge;

e. a plurality of flutes longitudinally cut in the first ring outer surface, through the sloped outer surface of the shoulder into the second ring outer surface, wherein each flute is oriented in parallel to other flutes and parallel to a longitudinal axis of the end ring;

f. a plurality of first ring fastener holes disposed through the first ring;

g. a plurality of second ring fastener holes disposed through the second ring;

h. a plurality of first diameter fasteners, wherein each first diameter fastener engages one of the first ring fastener holes to connect the first ring of the end ring to the tubular sheath at an edge of the tubular sheath; and i. a plurality of second diameter fasteners, wherein each second diameter fastener engages one of the second ring fastener holes to connect the second ring to the base pipe and wherein the end ring connects the tubular sheath to the base pipe allowing the downhole tool to be run downhole to a maximum depth of the wellbore with low torque and little drag without hanging up or sticking on well mud and well particulate flowing opposite the direction in which the downhole tool is run in the wellbore.

2. The end ring of claim 1, wherein the first ring fastener holes have identical diameters to the second ring fastener holes.

3. The end ring of claim 1, further comprising a plurality of rows of first ring fastener holes formed in the first ring; a plurality of rows of second ring fastener holes formed in the second ring; or combinations thereof.

4. The end ring of claim 1, wherein each flute has a tapered end.

5. The end ring of claim 1, wherein a quantity of fastener holes in the first ring is unequal to a quantity of fastener holes in the second ring.

6. The end ring of claim 1, wherein the first ring has an outer diameter from 1 inch to 36 inches.

7. The end ring of claim 1, wherein each flute has a depth from 5 percent to 55 percent of the thicknesses of the first ring or the second ring.

8. The end ring of claim 1, further comprising a layer of carbide material on the second ring outer surface as a cutting material for reaming the wellbore.

9. A swell packer for a wellbore, wherein the wellbore has a maximum depth, and wherein the swell packer comprises:

a. a base pipe;

b. a rubber exterior tubular disposed over the base pipe, wherein the rubber exterior tubular has a rubber tubular first end and a rubber tubular second end; and wherein the rubber exterior tubular comprises a hard high durometer material capable of withstanding pressures from 100 psi to 10,000 psi and temperatures from 100 degrees Fahrenheit to 500 degrees Fahrenheit;

c. a first end ring fastened between the base pipe and the rubber tubular first end;

d. a second end ring fastened between the base pipe and the rubber tubular second end; and wherein each end ring comprises:

(i) a first ring having an inner diameter, a first ring thickness a first ring outer surface, a first ring first edge, and a first ring second edge;

(ii) a second ring having the inner diameter, a second ring thickness, a second ring outer surface, a second ring first edge, and a second ring second edge; and wherein the second ring thickness is at least 25 percent greater than the first ring thickness;

(iii) a shoulder having the inner diameter, and wherein the shoulder has a sloped outer surface connecting the first ring second edge to the second ring first edge; and wherein the end ring slides over the base pipe and connects edges of the rubber exterior tubular to the base pipe;

(iv) a first ring lip formed on the first ring second edge;

(v) a plurality of flutes longitudinally cut in the first metal ring outer surface, through the sloped outer surface of the shoulder into the second ring outer surface, wherein each flute is oriented in parallel to other flutes and parallel to a longitudinal axis of each end ring;

(vi) a plurality of first ring fastener holes disposed through the first ring;

(vii) a plurality of second ring fastener holes disposed through the second ring;

(viii) a plurality of first diameter fasteners, wherein each first diameter fastener engages one of the first ring fastener holes to connect the first ring of each end ring to the rubber exterior tubular at an edge of the rubber exterior tubular; and (ix) a plurality of second diameter fasteners, wherein each second diameter fastener engages one of the second ring fastener holes to connect the second ring to the base pipe; and e. a collar connected to the base pipe, further wherein the first end ring and the second end ring allow the swell packer to be run downhole to a maximum depth of the wellbore with low torque and little drag without hanging up or sticking while being run into the wellbore.

10. The swell packer of claim 9, wherein the base pipe is steel.

11. The swell packer of claim 9, further comprising a second ring lip formed on the second ring second edge for providing a smooth engagement with the base pipe.

12. The swell packer of claim 9, wherein the rubber exterior tubular is adapted to swell with heat and fluid in a wellbore to twice the thickness of the rubber tubular.

13. The swell packer of claim 9, further comprising cutting ridges formed on the second ring outer surface.

* * * * *